US007850435B2

(12) United States Patent
Boehland et al.

(10) Patent No.: US 7,850,435 B2
(45) Date of Patent: Dec. 14, 2010

(54) FUEL INJECTION DEVICE FOR AN INTERNAL COMBUSTION ENGINE

(75) Inventors: Peter Boehland, Marbach (DE); Godehard Nentwig, Stuttgart (DE); Michael Bauer, Gerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 775 days.

(21) Appl. No.: 10/546,655

(22) PCT Filed: Oct. 13, 2003

(86) PCT No.: PCT/DE03/03394

§ 371 (c)(1),
(2), (4) Date: Aug. 24, 2005

(87) PCT Pub. No.: WO2004/076847

PCT Pub. Date: Sep. 10, 2004

(65) Prior Publication Data

US 2006/0193736 A1 Aug. 31, 2006

(30) Foreign Application Priority Data

Feb. 25, 2003 (DE) ..... 103 07 877

(51) Int. Cl.
*F04B 25/00* (2006.01)
*F04B 27/00* (2006.01)

(52) U.S. Cl. ..... 417/255; 417/273; 123/445; 123/446; 123/447; 123/495

(58) Field of Classification Search ..... 417/221, 417/222.1, 222.2, 255, 273, 286, 487, 488; 123/445, 495, 446, 447
See application file for complete search history.

(56) References Cited

U.S. PATENT DOCUMENTS

| | | | | |
|---|---|---|---|---|
| 5,794,594 | A * | 8/1998 | Fehlmann | 123/450 |
| 6,345,609 | B1 * | 2/2002 | Djordjevic | 123/509 |
| 6,510,843 | B2 * | 1/2003 | De Matthaeis | 123/506 |
| 6,694,950 | B2 * | 2/2004 | Djordjevic | 123/446 |
| 6,722,857 | B1 * | 4/2004 | Kellner et al. | 417/255 |
| 7,347,186 | B2 * | 3/2008 | Ricco et al. | 123/446 |
| 2001/0022171 | A1 | 9/2001 | Gaessler et al. | |
| 2002/0034448 | A1 | 3/2002 | De Matthaeis | |

(Continued)

FOREIGN PATENT DOCUMENTS

DE 199 26 308 A1 12/2000

(Continued)

*Primary Examiner*—Devon C Kramer
*Assistant Examiner*—Christopher Bobish
(74) *Attorney, Agent, or Firm*—Ronald E. Greigg

(57) ABSTRACT

A fuel injection apparatus has a high-pressure pump and a fuel-supply pump that delivers fuel from a fuel tank to the high-pressure pump. The high-pressure pump has a housing with an internal chamber that contains a drive unit for at least one pump element having a pump piston driven by the drive unit and delimiting a pump working chamber into which fuel is supplied via an inlet during an intake stroke and from which fuel is displaced via an outlet into the reservoir during a delivery stroke of the pump piston. The fuel-supply pump delivers fuel into the internal chamber via a connection that contains a check valve which opens toward the internal chamber of the housing and the inlet of the pump working chamber is connected to the internal chamber.

21 Claims, 2 Drawing Sheets

U.S. PATENT DOCUMENTS

| | | | | |
|---|---|---|---|---|
| 2003/0108443 | A1 * | 6/2003 | Suzuki et al. | 417/470 |
| 2004/0096337 | A1 * | 5/2004 | Kuhn et al. | 417/273 |

FOREIGN PATENT DOCUMENTS

| | | | |
|---|---|---|---|
| DE | 199 33 567 | C1 | 2/2001 |
| DE | 100 10 945 | A1 | 9/2001 |
| EP | 1 076 176 | A2 | 2/2001 |
| WO | WO 01/40656 | A1 | 6/2001 |

* cited by examiner

FUEL INJECTION DEVICE FOR AN INTERNAL COMBUSTION ENGINE

CROSS-REFERENCE TO RELATED APPLICATIONS

This application is a 35 USC 371 application of PCT/DE 03/03394 filed on Oct. 13, 2003.

BACKGROUND OF THE INVENTION

1. Field of the Invention

The invention is directed to an improved fuel injection apparatus for an internal combustion engine.

2. Description of the Prior Art

A fuel injection apparatus of the type with which this invention is concerned is known from WO 01/40656 A and has a high-pressure pump that delivers fuel into a reservoir from which fuel is drawn for injection into the engine. In addition, a fuel-supply pump is provided, which supplies fuel to the high-pressure pump from a fuel tank. The high-pressure pump has a housing and at least one pump element that is driven by a drive unit disposed in an internal chamber of the housing. The pump element has a pump piston, which is set into a stroke motion by the drive unit and delimits a pump working chamber. During an intake stroke of the pump piston, it draws fuel into the pump working chamber via an inlet and during a delivery stroke of the pump piston, it displaces fuel from the pump working chamber via an outlet. The pump piston moves into the internal chamber of the housing during its intake stroke and moves out from the internal chamber during its delivery stroke. The fuel-supply pump can be electrically or mechanically driven. In order to be able to generate a sufficiently high pressure, the fuel-supply pump requires a high-output, correspondingly costly drive unit. Alternatively, it is also possible for a fuel-supply pump with a low-output electric drive unit to be combined with an additional fuel-supply pump with a mechanical drive unit, but this is also costly.

The invention is based on a fuel injection apparatus for an internal combustion engine as generically defined by the preamble to claim 1.

A fuel injection apparatus of this kind is known from WO 01/40656 A. This fuel injection apparatus has a high-pressure pump that delivers fuel into a reservoir from which fuel is drawn for injection into the engine. In addition, a fuel-supply pump is provided, which supplies fuel to the high-pressure pump from a fuel tank. The high-pressure pump has a housing and at least one pump element that is driven by a drive unit disposed in an internal chamber of the housing. The pump element has a pump piston, which is set into a stroke motion by the drive unit and delimits a pump working chamber. During an intake stroke of the pump piston, it draws fuel into the pump working chamber via an inlet and during a delivery stroke of the pump piston, it displaces fuel from the pump working chamber via an outlet. The pump piston moves into the internal chamber of the housing during its intake stroke and moves out from the internal chamber during its delivery stroke. The fuel-supply pump can be electrically or mechanically driven. In order to be able to generate a sufficiently high pressure, the fuel-supply pump requires a high-output, correspondingly costly drive unit. Alternatively, it is also possible for a fuel-supply pump with a low-output electric drive unit to be combined with an additional fuel-supply pump with a mechanical drive unit, but this is also costly.

SUMMARY AND ADVANTAGES OF THE INVENTION

The fuel injection apparatus according to the invention has the advantage over the prior art that the high-pressure pump simultaneously constitutes a fuel-supply pump that delivers the fuel that is to be taken in during its intake strokes. The fuel-supply pump that delivers fuel from the fuel tank to the internal chamber of the housing of the high-pressure pump can therefore be embodied with a low output and therefore be inexpensively designed.

Advantageous embodiments and modifications of the fuel injection apparatus according to the invention are disclosed. One embodiment permits a continuous operation of the fuel-supply pump by allowing fuel that it delivers while the check valve is closed to flow out into the discharge region. Another embodiment permits a delivery quantity that is greater than the required intake quantity of the pump element and consequently also an overflow quantity that can be used to lubricate and cool the drive unit in the internal chamber of the housing.

BRIEF DESCRIPTION OF THE DRAWINGS

An exemplary embodiment of the invention is shown in the drawings and will be explained in detail herein below, in conjunction with the drawings, in which.

DESCRIPTION OF THE PREFERRED EMBODIMENT

Figure 1:
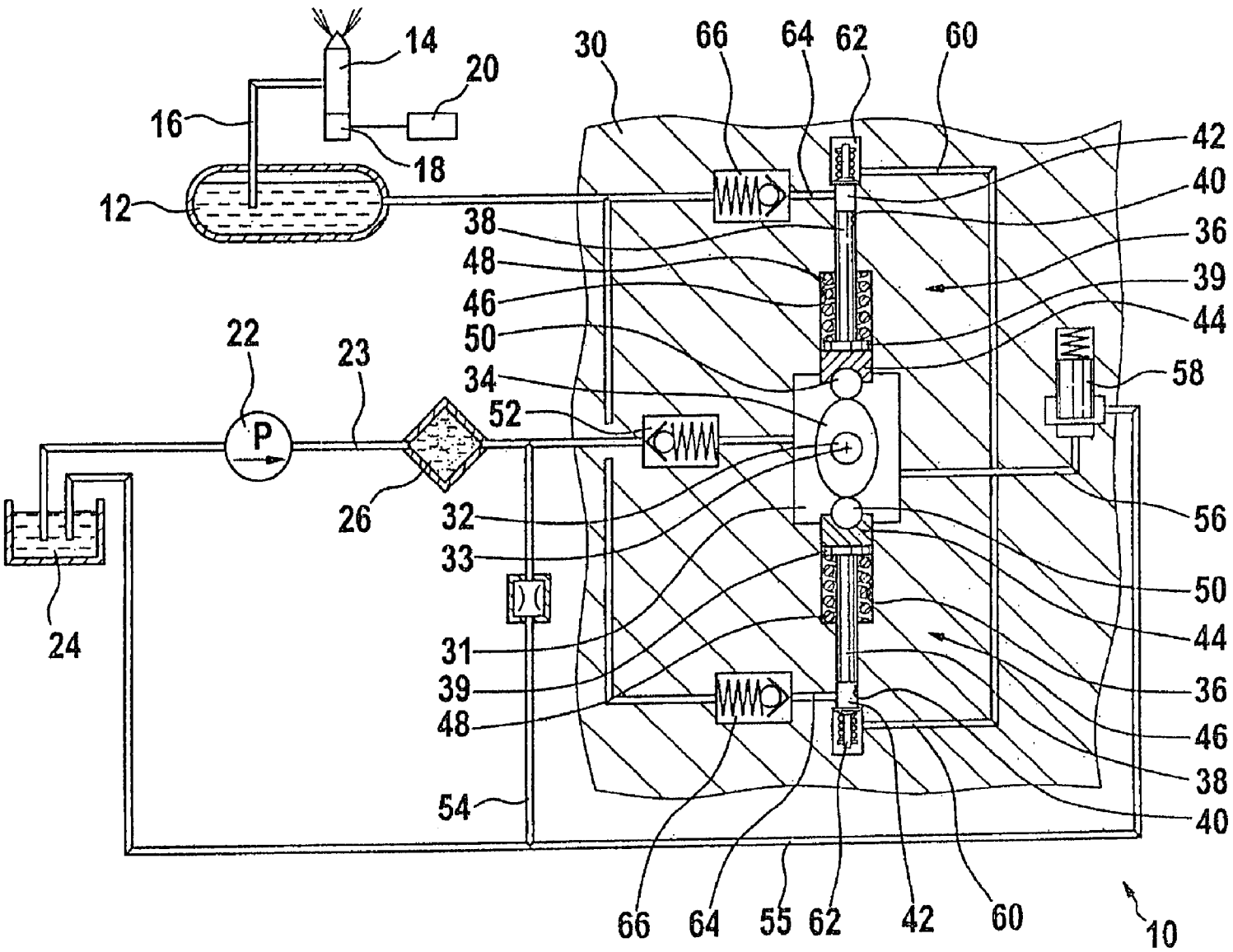
FIG. 1 is a schematic depiction of a fuel injection apparatus for an internal combustion engine, with a high-pressure pump at the end of the delivery stroke of its pump elements.

FIG. 1 shows a fuel injection apparatus of an internal combustion engine, for example of a motor vehicle, which has a high-pressure pump 10. The high-pressure pump 10 delivers highly pressurized fuel into a reservoir 12 from which fuel is drawn for injection into the engine. Each cylinder of the engine is provided with an injector 14 that is connected to the reservoir 12 via a line 16. The injector 14 has a control valve 18 that is triggered by an electronic control unit 20 and controls the opening of the injector 14 and consequently controls the fuel injection.

A fuel-supply pump 22 supplies fuel from a fuel tank 24 to the high-pressure pump 10. The fuel-supply pump 22 preferably has an electric drive unit, but can also be mechanically driven. Between the fuel-supply pump 22 and the high-pressure pump 10, a filter 26 is provided in order to filter the fuel delivered by the high-pressure pump 10.

The high-pressure pump 10 has a housing 30 with an internal chamber 31 in which a drive shaft 32 is supported so that it can rotate around an axis 33. For example, the engine drives the drive shaft 32. Inside the internal chamber 31, the drive shaft 32 has at least one cam 34; in the exemplary embodiment shown, a dual cam is provided, which has two cam protrusions disposed diametrically opposite from each other. The high-pressure pump 10 has at least one pump element 36 disposed in the housing 30; in the exemplary embodiment shown, two pump elements 36 are provided, which are disposed diametrically opposite from each other. Each pump element 36 has a pump piston 38 which is guided in a sealed fashion inside a cylinder bore 40 extending at least approximately radial to the rotation axis 33 of the drive shaft 32 and delimits a pump working chamber 42 in this cylinder bore 40 with its outward facing end surface. The cylinder bore 40 can be provided directly in the housing or in an insert piece that is inserted into the housing 30. With its end oriented radially inward, the pump piston 38 protrudes from the cylinder bore 40 and rests with a tappet 44 against the cam 34 of the drive shaft 30. The tappet 44 is guided in a sealed fashion in a bore 46 in the housing 30 and preferably has a larger diameter than the pump piston 38 in the region in which it is guided in the pump working chamber 42. The pump piston 38 has a larger diameter at its piston base 39 with which it rests against the tappet 44 than it does in its region that delimits the pump working chamber 42 and has a diameter approximately equal to that of the tappet 44. A prestressed spring 48, for example in the form of a helical compression spring, is clamped between the housing 30 and the piston base 39 and holds the pump piston 38 and, via its piston base 39, the tappet 44 in contact with the cam 34 of the drive shaft 32. A cylindrical roller 50 that rolls against the cam 34 is inserted into the end of the tappet 44 oriented toward the cam 34. The part of the tappet 44 that is oriented away from the pump piston 38 and protrudes from the bore 46 delimits the internal chamber 31 of the housing 30. The tappet 44 can also be omitted; in this case, the piston base 38 of the pump piston 38, which can, for example, have a roller 50 integrated into it, rests directly against the cam 34.

The fuel delivered by the fuel-supply pump 22 is supplied via a line 23 to the internal chamber 31 of the housing 30 of the high-pressure pump 10. The line 23 contains a check valve 52 that opens toward the internal chamber 31, thus preventing fuel from flowing out of the internal chamber 31 and to the fuel-supply pump 22. Between the fuel-supply pump 22 and the check valve 52, a line 54 leads from the line 23 to a discharge region that can, for example, be a return 55 to the fuel tank 24. From the internal chamber 31 of the housing 30 of the high-pressure pump 10, a line 56 leads to a discharge region that can once again be the return 55 to the fuel tank 24. The line 56 contains a discharge valve 58 that only opens the connection to the return 55 when a predetermined pressure is exceeded in the internal chamber 31 and keeps the connection to the return 55 closed when the pressure is low.

The pump working chambers 42 of the pump elements 36 are each fed by an inlet 60 that contains a check valve 62, which opens into the pump working chamber 42 and serves as an inlet valve. In addition, an outlet 64 leading from the pump working chamber 42 feeds into the reservoir 12 and contains a check valve 66, which opens away from the pump working chamber 42 and toward the reservoir 12 and functions as an outlet valve. The inlet 60 of each of the pump working chambers 42 of the pump elements 36 is connected to the internal chamber 31 of the housing 30 of the high-pressure pump 10. The pump pistons 38 of the pump elements 36 deliver synchronously with one another, i.e. they execute their respective delivery strokes and intake strokes at the same time as each other. When the pump pistons 38 execute their intake strokes, then the springs 48 cause them to move radially inward in accordance with the profile of the cam 34 against which the tappets 44 rest with their rollers 50, and the tappets 44 move out from the bore 46 and into the internal chamber 31. As a result, the volume of the internal chamber 31 is reduced so that the pressure in the internal chamber 31 increases; the check valve 52 prevents fuel from being displaced into the return 55. During the intake stroke of the pump pistons 38, a lower pressure prevails in the pump working chambers 42 than in the internal chamber 31 so that when the inlet valves 62 are open, fuel is displaced from the internal chamber 31 and is fed into the pump working chambers 42. During the delivery stroke of the pump pistons 38, the inlet valves 62 close and the outlet valves 66 open when a predetermined pressure is exceeded so that fuel is fed through the outlet 64 into the reservoir 12.

During the delivery stroke of the pump pistons 38, they are actuated by the cams 34 and move radially outward counter to the force of the springs 48 and the tappets 44 move into the bores 46 so that the volume of the internal chamber 31 increases. The check valve 52 opens as a result and fuel delivered by the fuel-supply pump 22 flows into the internal chamber 31 and fills it up. The fuel-supply pump 22 continuously delivers fuel and, when the check valve 52 is closed, fuel supplied by the fuel-supply pump 22 flows into the return 55 via the line 54.

Since the tappets 44 have a larger diameter than the pump pistons 38 in their regions delimiting the respective pump working chambers 42, they displace more fuel from the internal chamber 31 during the intake stroke of the pump pistons 38 than the pump pistons 38 draw into the pump working chambers 42. When the discharge valve 58 is open, the excess fuel flows into the return 55 via the line 56. This achieves a constant emptying and refilling of the internal chamber 31 with fuel and consequently provides a good lubrication and cooling of the drive unit of the high-pressure pump 10, particularly of the drive shaft 32, as well as the tappets 44 and the rollers 50 traveling on the cam 34. The fuel-supply pump 22 therefore only requires a relatively low pressure in order to be able to fill the internal chamber 31 with fuel. During the intake stroke of the pump pistons 38, they generate a relatively high pressure in the internal chamber 31, which permits a sufficient, rapid filling of the pump working chambers 42. It is also possible for the tappets 44 to have approximately the same diameter as the pump pistons 38 in their region that delimits the pump working chambers 42 so that the tappets 44 deliver a correspondingly lower fuel quantity.

Figure 2:
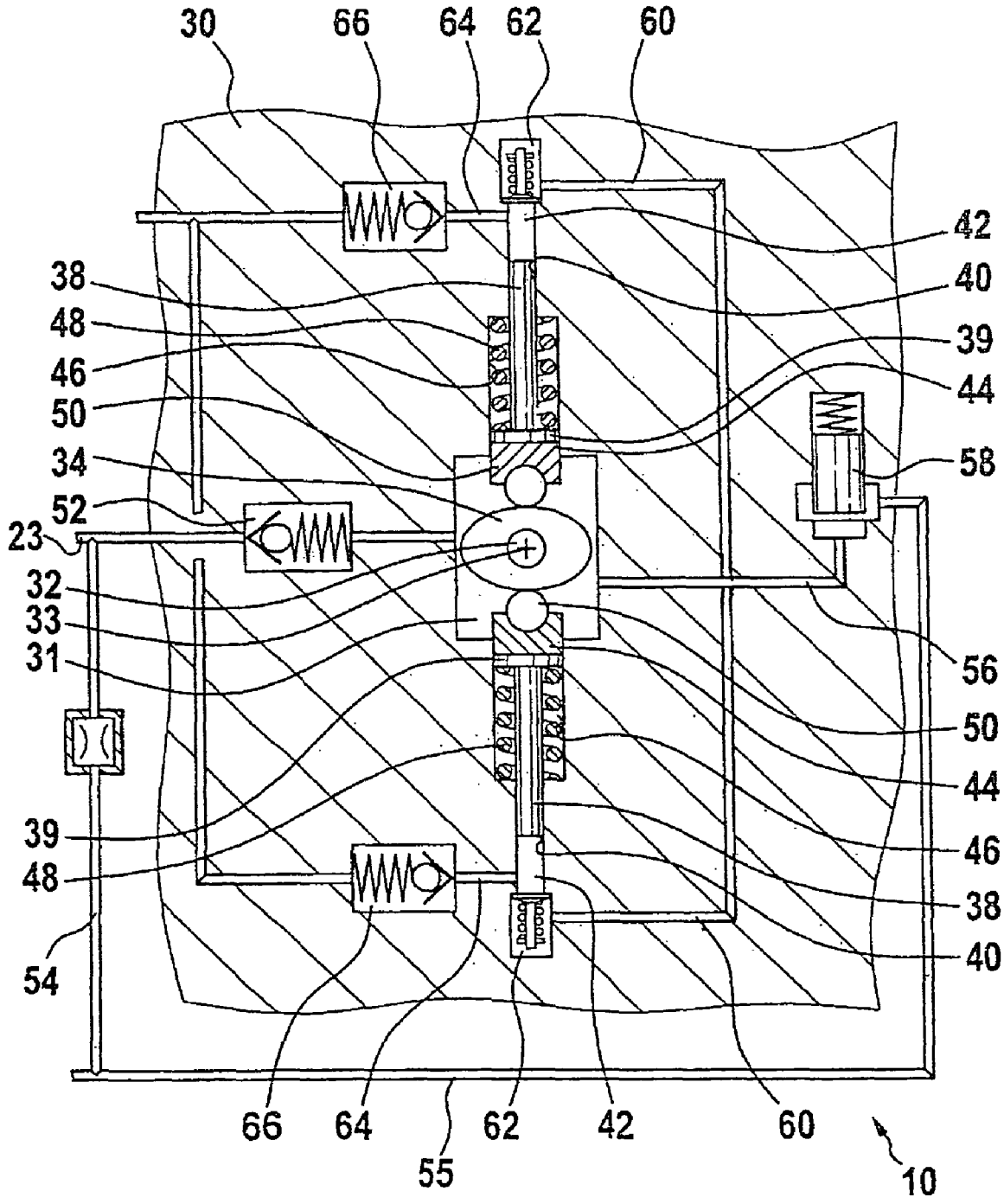
FIG. 2 shows the high-pressure pump at the end of the intake stroke of its pump elements.

FIG. 1 shows the high-pressure pump 10 at the end of the delivery stroke of the pump pistons 38, in which the pump pistons 38 are disposed in the region of their outer dead center. The tappets 44 are thus plunged to their greatest depth into the bores 46 and the volume of the internal chamber 31 is at its greatest. The inlet valves 62 are closed, the outlet valves 66 are open, and the check valve 52 is open so that the fuel-supply pump 22 delivers fuel into the internal chamber 31. FIG. 2 shows the high-pressure pump 10 at the end of the intake stroke of the pump pistons 38, in which the pump pistons 38 are disposed in the region of their inner dead center. The tappets 44 have moved their furthest out from the bores 46 and into the internal chamber 31 so that the volume of the internal chamber 31 is at its smallest. The inlet valves 62 are open; the outlet valves 66 and the check valve 52 are closed.

The foregoing relates to preferred exemplary embodiments of the invention, it being understood that other variants and embodiments thereof are possible within the spirit and scope of the invention, the latter being defined by the appended claims.

The invention claimed is:

1. A fuel injection apparatus for an internal combustion engine, the apparatus comprising a high-pressure pump (10) that delivers fuel into a reservoir (12) from which fuel is drawn for injection into the engine, a fuel-supply pump (22) that delivers fuel from a fuel tank (24) to the high-pressure pump (10), the high-pressure pump (10) having a housing (30) with an internal chamber (31) containing a drive unit (32, 34) for at least one pump element (36) of the high-pressure pump (10), the pump element (36) having a pump piston (38) driven into a stroke motion by the drive unit (32, 34) and delimiting a pump working chamber (42) into which fuel is supplied via an inlet (60) during an intake stroke of the pump piston (38) and from which fuel is displaced via an outlet (64) into the reservoir (12) during a delivery stroke of the pump piston (38), the pump piston (38) moving into the internal chamber (31) during its intake stroke and out from the internal chamber (31) during its delivery stroke, wherein during its intake stroke, the pump piston (38) causes a pressure increase in the internal chamber (31), a connection (23) containing a check valve (52) which connection directly delivers fuel from the fuel-supply pump (22) through the check valve and into the internal chamber (31), the check valve (52) being disposed in the housing between the fuel-supply pump and the internal chamber and opening toward the internal chamber (31) of the housing (30) such that the check valve (52) opens toward the internal chamber (31) and closes in an opposite direction, and means (62) for connecting the inlet (60) of the pump working chamber (42) to the internal chamber (31) so that during the intake stroke of the pump piston (38), fuel displaced from the internal chamber (31) by the movement of the piston toward the internal chamber (31) is drawn into the pump working chamber (42).

2. The fuel injection apparatus according to claim 1, further comprising a connection (54) between the fuel-supply pump (22) and the internal chamber (31) of the housing (30), the connection (54) leading from the connection (23) upstream of the check valve (52) to a discharge region (55).

3. The fuel injection apparatus according to claim 1, further comprising a prestressed spring (48) acting on the pump piston (38) in the direction of its intake stroke.

4. The fuel injection apparatus according to claim 2, further comprising a prestressed spring (48) acting on the pump piston (38) in the direction of its intake stroke.

5. The fuel injection apparatus according to claim 1, wherein the drive unit has a drive shaft (32) with at least one cam (34) that produces the stroke motion of the pump piston (38).

6. The fuel injection apparatus according to claim 2, wherein the drive unit has a drive shaft (32) with at least one cam (34) that produces the stroke motion of the pump piston (38).

7. The fuel injection apparatus according to claim 3, wherein the drive unit has a drive shaft (32) with at least one cam (34) that produces the stroke motion of the pump piston (38).

8. The fuel injection apparatus according to claim 1, wherein the pump piston (38) rests against the drive unit (32, 34) with a tappet (44) that is guided in a sealed fashion in a bore (46) of the housing (30) and partially delimits the internal chamber (31).

9. The fuel injection apparatus according to claim 2, wherein the pump piston (38) rests against the drive unit (32, 34) with a tappet (44) that is guided in a sealed fashion in a bore (46) of the housing (30) and partially delimits the internal chamber (31).

10. The fuel injection apparatus according to claim 8, wherein the tappet (44) has a greater diameter than the pump piston (38) in its region that delimits the pump working chamber (42).

11. The fuel injection apparatus according to claim 5, wherein the cam (34) is a multiple cam.

12. The fuel injection apparatus according to claim 7, wherein the cam (34) is a multiple cam.

13. The fuel injection apparatus according to claim 7, wherein the cam (34) is a multiple cam.

14. The fuel injection apparatus according to claim 1, wherein the means (62) for connecting the inlet (60) of the pump working chamber (42) to the internal chamber (31) comprises a check valve (62) that opens toward the pump working chamber (42).

15. The fuel injection apparatus according to claim 2, wherein the means (62) for connecting the inlet (60) of the pump working chamber (42) to the internal chamber (31) comprises a check valve (62) that opens toward the pump working chamber (42).

16. The fuel injection apparatus according to claim 5, wherein the means (62) for connecting the inlet (60) of the pump working chamber (42) to the internal chamber (31) comprises a check valve (62) that opens toward the pump working Chamber (42).

17. The fuel injection apparatus according to claim 8, wherein the means (62) for connecting the inlet (60) of the pump working chamber (42) to the internal chamber (31) comprises a check valve (62) that opens toward the pump working chamber (42).

18. The fuel injection apparatus according to claim 1, wherein the high-pressure pump (10) has a number of pump elements (36).

19. The fuel injection apparatus according to claim 1, further comprising a connection (56) leading from the internal chamber (31) of the housing (30) to a discharge region (55), the connection (56) containing a discharge valve (58) that opens the connection (56) when a predetermined pressure in the control chamber (31) is exceeded.

20. The fuel injection apparatus according to claim 2, further comprising a connection (56) leading from the internal chamber (31) of the housing (30) to a discharge region (55), the connection (56) containing a discharge valve (58) that opens the connection (56) when a predetermined pressure in the control chamber (31) is exceeded.

21. The fuel injection apparatus according to claim 14, further comprising a connection (56) leading from the internal chamber (31) of the housing (30) to a discharge region (55), the connection (56) containing a discharge valve (58) that opens the connection (56) when a predetermined pressure in the control chamber (31) is exceeded.

* * * * *

UNITED STATES PATENT AND TRADEMARK OFFICE

CERTIFICATE OF CORRECTION

PATENT NO. : 7,850,435 B2
APPLICATION NO. : 10/546655
DATED : December 14, 2010
INVENTOR(S) : Peter Boehland et al.

It is certified that error appears in the above-identified patent and that said Letters Patent is hereby corrected as shown below:

Figure 1: Number 36 and 46 should be reversed.

Column 6, Line 12: Delete "7" and insert -- 6 --.

Signed and Sealed this
Twenty-second Day of March, 2011

David J. Kappos

David J. Kappos
*Director of the United States Patent and Trademark Office*